US009019801B2

(12) United States Patent
Fleury et al.

(10) Patent No.: US 9,019,801 B2
(45) Date of Patent: Apr. 28, 2015

(54) ELECTROMECHANICAL TIMEPIECE PROVIDED WITH AN ADDITIONAL FUNCTION

(75) Inventors: Emmanuel Fleury, Moutier (CH); Andre Zanetta, Wavre (CH); Martin Bisig, Zuchwil (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 357 days.

(21) Appl. No.: 13/617,658

(22) Filed: Sep. 14, 2012

(65) Prior Publication Data

US 2013/0077450 A1 Mar. 28, 2013

(30) Foreign Application Priority Data

Sep. 28, 2011 (EP) ..... 11183105

(51) Int. Cl.

| | |
|---|---|
| ***G04B 37/04*** | (2006.01) |
| ***G04B 47/06*** | (2006.01) |
| ***G04B 19/06*** | (2006.01) |
| ***G04C 10/04*** | (2006.01) |

(52) U.S. Cl.

CPC ..... *G04B 37/0427* (2013.01); *G04B 19/06* (2013.01); *G04C 10/04* (2013.01); *G04B 47/066* (2013.01)

(58) Field of Classification Search

CPC ..... G04B 19/06; G04B 19/087; G04B 37/04; G04B 37/0427; G04B 47/06; G04B 47/065; G04B 47/066; G04C 10/04

USPC ..... 368/76, 80, 220, 223

See application file for complete search history.

(56) References Cited

U.S. PATENT DOCUMENTS

| | | | | |
|---|---|---|---|---|
| 4,370,063 | A * | 1/1983 | Lee | 368/71 |
| 4,720,820 | A * | 1/1988 | Siefert | 368/76 |
| 5,297,112 | A * | 3/1994 | Cohen et al. | 368/190 |

(Continued)

FOREIGN PATENT DOCUMENTS

| | | | |
|---|---|---|---|
| CH | 684769G | A3 | 12/1994 |
| EP | 1 840 678 | A1 | 10/2007 |

(Continued)

OTHER PUBLICATIONS

European Search Report issued Nov. 18, 2011 in corresponding European Application No. 11 18 3105 filed on Sep. 28, 2011 (with an English Translation).

*Primary Examiner* — Vit W Miska

(74) *Attorney, Agent, or Firm* — Oblon, McClelland, Maier & Neustadt, L.L.P.

(57) ABSTRACT

Electromechanical timepiece fitted with a gear train including an hour hand and a minute hand for the current time display on the dial side of the timepiece. The timepiece is arranged to provide at least one additional piece of information relating to a magnitude of time, or to a non-time related piece of information. The timepiece further includes an additional indicator hand arranged to display the additional information, the additional indicator hand being mounted on the back cover side of the timepiece on an arbour of the gear train of the timepiece, so that the additional indicator hand and the hour hand and/or minute hand rotate at the same time and at the same angle, the hour hand and/or the minute hand being driven either to display the current time, or to enable the additional indicator hand to indicate the additional information.

8 Claims, 2 Drawing Sheets

(56) References Cited

U.S. PATENT DOCUMENTS

| | | | | |
|---|---|---|---|---|
| 5,305,290 | A * | 4/1994 | Yoo | 368/76 |
| 5,377,171 | A * | 12/1994 | Schlup | 368/220 |
| 2006/0034161 | A1 | 2/2006 | Muller | |
| 2009/0257323 | A1 | 10/2009 | Soltani | |

FOREIGN PATENT DOCUMENTS

| | | | |
|---|---|---|---|
| GB | 2 241 868 | A | 9/1991 |
| WO | WO 2004/029729 | A2 | 4/2004 |
| WO | WO 2009/126794 | A2 | 10/2009 |

* cited by examiner

ELECTROMECHANICAL TIMEPIECE PROVIDED WITH AN ADDITIONAL FUNCTION

The present invention concerns an electromechanical timepiece provided with an additional function. More specifically, the present invention relates to an electromechanical wristwatch able to provide an additional indication as well as displaying the current time. One example of this type of watch is a solar watch including a rechargeable accumulator powered by a photovoltaic cell and capable of providing its user with an indication of the state of charge of the accumulator. Another example of this type of watch is a compass watch, which can indicate to its user the direction of magnetic north in addition to indicating the current time.

There is a strong tendency in the field of horology to supply watches capable of displaying an endlessly increasing number of indications. Thus, in addition to the current time indication, current timepieces frequently provide indications of the date, month and current year, or are provided with a chronograph mechanism and therefore have additional dials for displaying the measured time. Current timepieces may also comprise electronic functions such as a compass, or be powered by an accumulator that can be charged by a solar cell, and for which an indication of the state of charge must be provided to the user.

Faced with the increased number of functions to be displayed, two different strategies may be envisaged. The first of these strategies consists in fitting the watch, for example, with touch sensitive keys which allow the user to access submenus for activating the additional function or functions, from a basic operating mode of the watch in which it typically displays the current time. Touch sensitive key technology is, however, relatively expensive, which means it is reserved for luxury watches. The second strategy consists in displaying all of the watch functions by means of additional dials arranged on the watch dial. However, this strategy is limited by the space available on the surface of the dial and the concern that the information provided by the watch remains legible to the user.

It is an object of the present invention to overcome the aforementioned problems, in addition to others, by providing an electromechanical timepiece, which, in addition to indicating the current time, can supply at least one additional indication relating to an additional function. This additional indication may be a magnitude of time or a non-time related piece of information.

The present invention therefore concerns an electromechanical timepiece provided with a gear train comprising at least one hour hand and one minute hand for displaying the current time on the dial side of the timepiece. The hour hand and the minute hand are driven by a common electric motor or by separate electric motors. The timepiece is further arranged to supply at least one additional piece of information relating to a magnitude of time or to non-time related information. The timepiece is characterized in that it further includes an additional indicator hand arranged to display the additional information, wherein said additional indicator hand is mounted on the back cover side of the timepiece on a gear train arbour of said timepiece, so that the additional indicator hand and the hour hand and/or minute hand rotate at the same time and at the same angle, and the hour and/or minute hands are driven either to display the current time, or to allow the additional indicator hand to display the additional information.

Owing to these features, the present invention provides a timepiece which, in addition to the current time indication on the dial side, is arranged to provide an additional indication which is displayed, not on the dial side, but on the back cover side of the timepiece. A space saving is thus achieved on the dial, which may either be used to display the time or other indications in larger dimensions, or to display one or more additional indications. This means that the user need only turn over his watch in order to be able to read the additional indication. It will be clear that in normal operating mode, the additional function indicator hand, fixedly mounted on a gear train arbour, is driven at the same time and at the same speed as this arbour.

According to a complementary feature of the invention, the timepiece is either fitted with a means for automatically detecting when the timepiece is turned over, or a control member that can be activated by the user to indicate to the timepiece that it has been turned over.

Thus, when the timepiece is turned over, it enters into an operating mode in which the particular current time display wheel, on the arbour of which the additional function indicator hand is mounted, is no longer driven by its motor to indicate the current time, but is driven by the same motor to enable the indicator hand mounted on the back cover side of the watch to supply the indication relating to the additional function. During this period of time, the timepiece no longer provides an exact indication of the current time. This is not, however, a disadvantage, since when the user consults the additional function indication, he is holding his watch turned over, so he cannot read the current time indication provided by the hour and minute hands which move above the watch dial. However, to correct this problem, it is possible to envisage driving the current hour display wheels at high speed, at regular time intervals, for example, once per minute, typically at a speed of five revolutions per second, to correct the current time indication.

According to a preferred embodiment of the invention, the additional function indicator hand is mounted on an arbour integral with the seconds pinion. The seconds hand and additional function indicator hand thus rotate at the same time and at the same angle in the current time display mode. In the additional function display mode, the seconds hand is no longer driven by its motor to display the current time, but to enable the indicator hand mounted on the back cover side of the watch to provide an indication relating to the additional function.

According to a first variant, the timepiece according to the invention is a solar wristwatch which includes a photovoltaic cell mounted in the back cover of the watch and wherein the additional indicator hand is used to indicate to the person wearing the watch the state of charge of the accumulator powered by the photovoltaic cell. When the user is wearing his solar watch on the wrist, the solar cell is in darkness. However, as soon as the user turns his watch over, the photovoltaic cell starts to convert the incident light into electricity. Consequently, the watch detects the inflow of light which falls on the photovoltaic cell and deduces that the watch has been turned over. The watch then enters the additional function display mode in which the additional function indicator hand indicates the state of battery charge to the user.

According to a second variant of the invention, the timepiece is a compass watch and the additional hand is used to indicate the direction of magnetic north. When the user wishes to use the compass, he exerts pressure on a pushbutton to tell the watch that it has to enter the additional function display mode. The seconds hand is then no longer being driven by its motor to display the current time, but to enable the additional hand to indicate the direction of magnetic north. It is also possible to envisage fitting the timepiece with a means for allowing it to detect that it has been turned over and to enter the additional information display mode relating to the direction of terrestrial magnetic north.

According to a third variant of the invention, the timepiece is a watch capable of providing meteorological information. In this case, the additional hand is used to give indications as to the change in climatic conditions.

According to a fourth variant of the invention, the additional indicator hand is used to provide the current date indication.

Other features and advantages of the present invention will appear more clearly from the following detailed description of various embodiments of the timepiece according to the invention. These examples are given solely by way of non-limiting illustration with reference to the annexed drawing, in which.

The present invention proceeds from the general inventive idea which consists in adding an indication of a time-related magnitude, or a non-time related piece of information to the back of a timepiece. On the back cover side of the timepiece an indicator hand is therefore arranged, mounted on an arbour integral with one of the current time display wheels, preferably the seconds wheel. The seconds wheel, or in other words the seconds hand, and the additional function indicator hand thus rotate at the same time and at the same angle in the current time display mode. In the additional display indicator mode, the seconds hand is no longer driven by its motor to indicate the current time, but to enable the additional hand to provide an indication related to the additional function. The present invention therefore has two essential advantages: firstly, it allows an indication of a magnitude related to an additional function to be added to the back cover of the timepiece, which frees space on the watch dial. It is therefore possible to display larger sized indications on the dial or to display one or more additional indications. Secondly, the present invention does not require substantial modifications of existing calibres. Indeed, it is sufficient to extend the arbour of the seconds wheel, in order to mount the additional hand at the free end thereof, and to slightly alter the control software of the watch, so that the motor that normally drives the seconds hand for the current time display also drives said hand to allow the indicator hand arranged on the back cover side of the watch to display information relating to the additional function.

Figure 1:
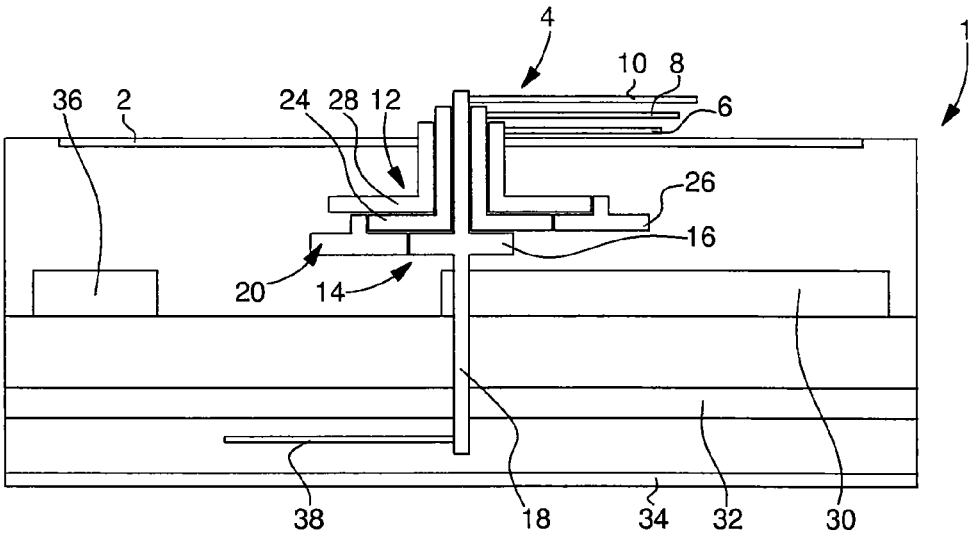
FIG. 1 is a schematic cross-section of an electromechanical watch case according to the invention.

FIG. 1 is a schematic cross-section of an electromechanical watch case according to the invention. Designated as a whole by the general reference numeral 1, this watch case is delimited at the top by a dial 2, which defines the front face of the watch and above which a set of hands 4 moves, comprising an hour hand 6, minute hand 8 and seconds hand 10. This set of hands 4 is driven by a gear train 12, which conventionally comprises a motion wheel set, formed of a seconds wheel set 14, whose seconds pinion 16 receives drive pulses from a motor (not shown in the drawing). An arbour 18 of the seconds pinion carries the seconds hand 10. The assembly is completed by a minute wheel set 20, the minute wheel 22 of which drives a cannon-pinion 24, to which the minute hand 8 is secured. Minute pinion 26 drives an hour wheel 28 onto which the hour hand 6 is driven. It goes without saying that the various wheel sets forming the motion wheel set could each be driven by an independent motor instead of being driven by a single motor.

The operation of the watch is assured by an electronic movement 30 housed in the inner volume of watch case 1. The watch is supplied with electrical energy by a photovoltaic cell 32, arranged on the side of a transparent back cover 34, which delimits the watch case 1 on the bottom by defining a back face thereof. Photovoltaic cell 32 supplies current to a rechargeable battery 36.

According to the invention, the length of the seconds pinion arbour 18 is increased by a value typically comprised between 0.5 and 3 mm to take account of the sum of the thicknesses of a printed circuit board (not shown in the drawing) on which the electronic movement 30 is mounted, and of photovoltaic cell 32, and thus to allow the seconds pinion arbour 18 to emerge from the back face of watch case 1. Consequently, and in accordance with the invention, an additional indicator hand 38, which will move underneath transparent back cover 34, is mounted on the free end of seconds pinion arbour 18. It is clear that, by design, additional indicator hand 38 is mounted in parallel with seconds hand 10 so that these two hands 38 and 10 are always driven at the same time and at the same angle.

In the example shown in FIG. 1, the watch according to the invention is a photovoltaic watch. Additional indicator hand 38 will therefore be used to indicate the state of charge of battery 36 to the user. Since photovoltaic cell 32 is mounted on the side of transparent back cover 34 of watch case 1, the photovoltaic effect can only be produced when watch case 1 is turned over. Either the user takes the watch off his wrist and places it upside down on a support, or the watch is of the reversible type, i.e. watch case 1 is mounted to pivot 180° in a frame, and in this case the user can turn watch case 1 over to expose photovoltaic cell 32 to the ambient light without having to remove the watch from his wrist.

Two solutions can be envisaged to make the watch according to the invention enter its additional indication display mode. The first consists in providing the watch according to the invention with a push-button or other additional control means which can simply be pressed by the user to tell the watch that it has been turned over and that it must enter its additional indication display mode. The second solution is for solar watches. When the watch is turned over and photovoltaic cell 32 is exposed to the ambient light, the watch control circuit detects the increase in current produced by photovoltaic cell 32 and deduces that the watch has been turned over. As a result, the control circuit forces the watch to enter the additional function display mode in which indicator hand 38 of the additional function indicates to the user the state of charge of battery 36.

It will be clear that when the watch according to the invention enters its additional function display mode, it can no longer indicate the current time. Indeed, as already mentioned above, the additional indicator hand 38 is integral with seconds pinion arbour 18 onto which seconds hand 10 is driven, so that these two hands 38 and 10 are always driven at the same time and at the same angle. Consequently, when the additional indicator hand 38 moves underneath the transparent back cover 34 to provide the user with information relating to the additional function, seconds hand 10 moves in unison and the current time display is distorted. However, this is not a problem given that, when the user turns his watch over to consult the information provided by the additional indicator hand 38, he cannot see the current time display hand at the same time on the front face of the watch. It is, however, entirely possible to envisage resetting the time of the watch at regular time intervals, for example every minute, by driving the current time display hands 6, 8 and 10 at high speed, typically at a speed of five revolutions per second, to correct the current time indication. This variant is particularly advantageous where the watch according to the invention remains turned over for quite a long period of time.

Hour hand 6, minute hand 8 and seconds hand 10 can be driven by a single motor. In this case, all of the current time display hands rotate when the watch enters its additional function display mode. It is also possible for each of the current time display hands to be driven by its own motor. In that case, only the seconds display hand 10 is driven by the additional indicator hand 38 when the latter moves.

In the case described above, the additional indicator hand 38 is mounted on the second pinion arbour 18, which carries seconds hand 10 at the opposite end thereof. It goes without saying that it is also possible to envisage mounting the additional indicator hand 38 on any arbour of gear train 12 of the watch, provided that the length of said arbour is increased to make it emerge from the back face of the watch.

Figure 2:
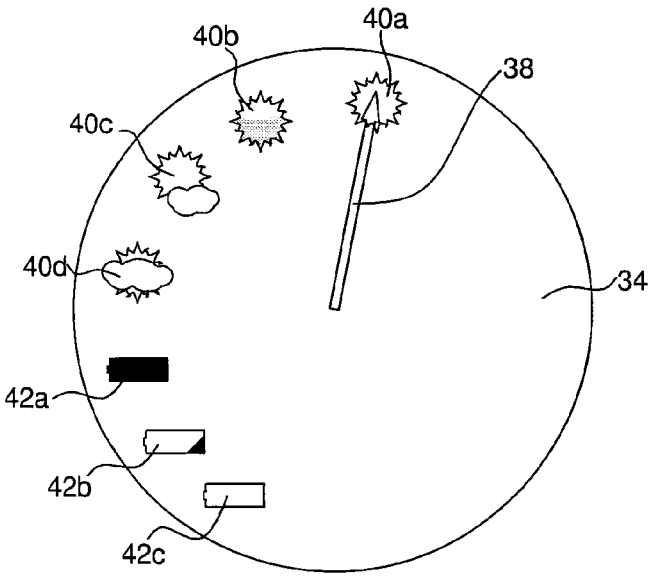
FIG. 2 is a bottom view of the electromechanical watch according to the invention in which the transparent back cover of the watch is visible.

FIG. 2 is a bottom view of the electromechanical watch according to the invention showing the transparent back cover 34 of the watch. Symbols are added by any suitable means to the inner surface of transparent back cover 34. A first series of icons 40*a*-40*d*, representing the sun, displays the intensity of charge according to the degree of sunlight. A second series of icons 42*a*-42*d* representing the battery in several states of charge indicate the state of charge of battery 36.

By way of purely illustrative and non limiting example, it is possible to envisage implementing an algorithm in the control circuit of electronic movement 30, in order to combine the charge power display and the display of the state of charge of battery 36 by means of the single additional indicator hand 38 in accordance with the following operating principle. Above a certain sunlight threshold, for example 10 kLux, the additional indicator hand 38 displays the intensity of charge of battery 36 by pointing to one of the symbols 40*a*-40*d* representing the sun. When battery 36 is charged, the additional indicator hand 38 points to the symbol 42*a* indicating that battery 36 is full regardless of the intensity of the sunlight. Finally, below the sunlight threshold of 10 kLux, the additional indicator hand 38 indicates the state of charge of battery 36 by pointing to one of icons 42*a*-42*c* representing battery 36 in several states of charge. Indeed, below the sunlight threshold of 10 kLux, battery 36 is not charging or virtually not charging, as the light intensity is too low. After a certain time in this mode, the watch returns to the current time display mode.

Thus, the user permanently knows whether battery 36 is charging or not and he can control the proper positioning of the watch relative to the available light. The user can, at any time, check the charge progress by placing the watch in shadow in order to go below the sunlight threshold. He can then place his watch in the sun again and immediately be informed as to the available charge power.

Figure 3:
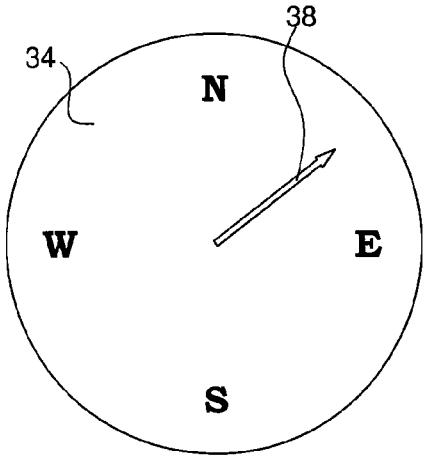
FIG. 3 is a similar view to that of FIG. 2, wherein the additional function consists of a compass.

FIG. 3 is a similar view to that of FIG. 2, where the additional function consists of a compass. In this case, either the watch has a means for detecting that it has been turned over, or the user activates a control means enabling him to tell the watch that it has been turned over and that it has to enter its additional indication display mode. In the present case, the additional indicator hand 38 will indicate the direction of terrestrial magnetic north.

Figure 4:
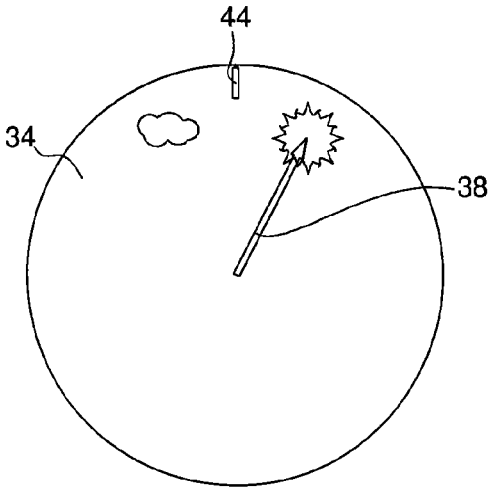
FIG. 4 is a similar view to that of FIG. 2, wherein the additional function is a barometric indicator.

FIG. 4 is a similar view to that of FIG. 2, where the additional function is a barometric indicator. When the watch enters its additional indication display mode, the additional indicator hand 38 will be positioned on either side of an index 44 for indicating either an increase in barometric pressure and thus an improvement in weather conditions, or a decrease in atmospheric pressure and thus a worsening of the weather.

Figure 5:
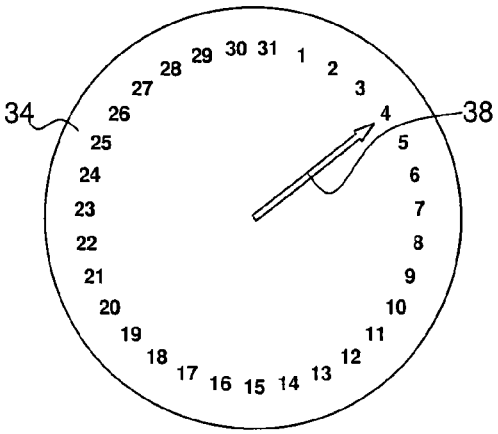
FIG. 5 is a similar view to that of FIG. 2, wherein the additional function is a date indication.

FIG. 5 is a similar view to that of FIG. 2, where the additional function is a date indication. When the watch enters its additional indication display mode, the additional indicator hand 38 will point to the current date for a predetermined period of time.

It goes without saying that this invention is not limited to the embodiment that has just been described and that various simple alterations and variants can be envisaged by those skilled in the art without departing from the scope of the invention as defined by the claims annexed to this Patent Application. It will be clear, in particular, that if the hour and minute hands and, where appropriate, the seconds hand, are driven by a single electric motor, these hands will rotate at the same time as the additional indicator hand. However, if these hands are each driven by an independent motor, only the time display hand on the arbour on which the additional indicator hand is mounted will rotate at the same time and same angle as the indicator hand. It is also possible to envisage fitting the watch according to the invention with an inclination detector enabling the watch control circuit to detect that the watch is in a turned over position.

What is claimed is:

1. An electromechanical timepiece fitted with a gear train comprising at least an hour hand and a minute hand for the current time display on the dial side of the timepiece, said hour hand and said minute hand being driven by a common electric motor or by separate electric motors, the timepiece further being arranged to provide at least one additional piece of information relating to a magnitude of time, or to a non-time related piece of information, wherein said timepiece further includes an additional indicator hand arranged to display the additional information, said additional indicator hand being mounted on the back cover side of the timepiece on an arbour of the gear train of said timepiece, so that the additional indicator hand and the hour hand or minute hand rotate at the same time and at the same angle, the hour hand and/or the minute hand being driven either to display the current time, or to enable the additional indicator hand to indicate the additional information.

2. The timepiece according to claim 1, wherein said timepiece either includes a user actuator configured to indicate to the timepiece that said timepiece has been turned over, or a detection mechanism configured to detect that said timepiece has been turned over and to enter into an additional information display mode.

3. The timepiece according to claim 2, wherein said timepiece includes a correction mechanism configured to correct the current time indication at regular time intervals when the timepiece is in the additional information display mode.

4. An electromechanical timepiece fitted with a gear train comprising at least an hour hand, a minute hand and a seconds hand for the current time display on the dial side of the timepiece, said hour hand, said minute hand and said seconds hand being driven by a common electric motor or by separate electric motors, the timepiece further being arranged to provide at least one additional piece of information relating to a magnitude of time, or to a non-time related piece of information, wherein said timepiece further includes an additional indicator hand arranged to display the additional information, said additional indicator hand being mounted on the back cover side of the timepiece on an arbour of the gear train of said timepiece, so that the additional indicator hand and the hour hand, the minute hand or the seconds hand rotate at the same time and at the same angle, the hour hand, the minute hand and the seconds hand being driven either to display the current time, or to enable the additional indicator hand to indicate the additional information, wherein said timepiece further includes a seconds pinion on an arbour of which the additional indicator hand is rigidly mounted.

5. An electromechanical timepiece fitted with a gear train comprising at least an hour hand, a minute hand and a seconds hand for the current time display on the dial side of the timepiece, said hour hand, said minute hand and said seconds hand being driven by a common electric motor or by separate electric motors, the timepiece further being arranged to provide at least one additional piece of information relating to a magnitude of time, or to a non-time related piece of information, wherein said timepiece further includes an additional indicator hand arranged to display the additional information, said additional indicator hand being mounted on the back cover side of the timepiece on an arbour of the gear train of said timepiece, so that the additional indicator hand and the hour hand, the minute hand or the seconds hand rotate at the same time and at the same angle, the hour hand, the minute hand and the seconds hand being driven either to display the current time, or to enable the additional indicator hand to indicate the additional information, wherein the timepiece either includes a user actuator configured to indicate to the timepiece that said timepiece has been turned over, or a detection mechanism configured to detect that said timepiece has been turned over and to enter into an additional information display mode, and wherein the timepiece further includes a seconds pinion on an arbour of which the additional indicator hand is rigidly mounted.

6. An electromechanical timepiece fitted with a gear train comprising at least an hour hand, a minute hand and a seconds hand for the current time display on the dial side of the timepiece, said hour hand, said minute hand and said seconds hand being driven by a common electric motor or by separate electric motors, the timepiece further being arranged to provide at least one additional piece of information relating to a magnitude of time, or to a non-time related piece of information, wherein said timepiece further includes an additional indicator hand arranged to display the additional information, said additional indicator hand being mounted on the back cover side of the timepiece on an arbour of the gear train of said timepiece, so that the additional indicator hand and the hour hand, the minute hand or the seconds hand rotate at the same time and at the same angle, the hour hand, the minute hand and the seconds hand being driven either to display the current time, or to enable the additional indicator hand to indicate the additional information, wherein the timepiece includes a correction mechanism configured to correct the current time indication at regular time intervals when the timepiece is in the additional information display mode, wherein the timepiece further includes a seconds pinion on an arbour of which the additional indicator hand is rigidly mounted.

7. The timepiece according to claim 1, wherein said timepiece includes a photovoltaic cell arranged on the back cover side of the timepiece, said photovoltaic cell supplying electric current to a rechargeable battery, and the additional indicator hand being arranged to indicate a state of charge of the rechargeable battery.

8. The timepiece according to claim 7, wherein said timepiece includes a detection mechanism configured to cause said timepiece to enter into an additional information display mode relating to the state of charge of the rechargeable battery when said detection mechanism detects an increase in a current produced by the photovoltaic cell.

* * * * *